United States Patent [19]

Robertson

[11] 4,006,696

[45] Feb. 8, 1977

[54] FLOATING PRESSER FOOT FOR QUILTING MACHINE

[75] Inventor: Joe E. Robertson, Santa Ana, Calif.

[73] Assignee: Kirsch Company, Sturgis, Mich.

[22] Filed: Jan. 12, 1976

[21] Appl. No.: 648,003

[52] U.S. Cl. ..... 112/117

[51] Int. Cl.[2] ..... D05B 11/00

[58] Field of Search ..... 112/3 R, 117, 118, 119

[56] References Cited

UNITED STATES PATENTS

| | | | |
|---|---|---|---|
| 2,218,785 | 10/1940 | Boettcher | 112/117 |
| 3,147,720 | 9/1964 | Kuhn | 112/117 |
| 3,385,246 | 5/1968 | Schlegel | 112/118 |
| 3,633,525 | 1/1972 | Landoni | 112/117 |
| 3,669,045 | 6/1972 | Landoni | 112/118 |
| 3,749,037 | 7/1973 | Cash | 112/117 |

*Primary Examiner*—G. V. Larkin

*Attorney, Agent, or Firm*—Philip M. Hinderstein

[57] ABSTRACT

In a quilting machine of the type including a bed plate, means for conducting material to be quilted over the bed plate, vertically reciprocal needles positioned above the bed plate for moving sewing threads through the material to form stitches therein, a presser foot positioned above the bed plate, means for supporting the presser foot for vertical reciprocation relative to the bed plate between upper and lower positions for periodically compressing and releasing the material, and means for driving the presser foot, there is disclosed an improvement wherein the presser foot supporting means comprises means including a pair of opposed, balanced springs for suspending the presser foot in a position intermediate the upper and lower positions, and wherein the presser foot driving means comprises means for cyclically, alternately, increasing and decreasing the compression of one of the springs and simultaneously decreasing and increasing the compression of the other of the springs to reciprocate the presser foot between the upper and lower positions.

13 Claims, 2 Drawing Figures

20
36
35
19
18
37
22
25
24
23
34
33
42
10
17
38
39
41
32
26
14
27
31
16
16
14
30
28
31
13
11
13
12
15

FLOATING PRESSER FOOT FOR QUILTING MACHINE

BACKGROUND OF THE INVENTION

1. Field of the Invention

The present invention relates to a floating presser foot for a quilting machine and, more particularly, to a presser foot suspension and drive system which substantially eliminates the noise, vibration, and wear normally associated with quilting machine presser foot systems.

2. Description of the Prior Art

Quilting machines of the general type including a bed plate, material supporting means including material feeding means for conducting material to be quilted over the bed plate, sewing thread supply means, a plurality of vertically reciprocal needles mounted on a needle support bar positioned above the bed plate for moving a plurality of threads through the material and the bed plate, vertically reciprocal presser foot means positioned above the bed plate for holding the material on the bed plate during formation of the stitches and for holding the material during removal of the needles therefrom, thread take-up means positioned between the thread supply means and the needles for controlling the tension in the threads during the formation of the stitches, and pattern controlling means for moving the material supporting means laterally in a preselected relationship with the material feeding means for obtaining sewing patterns, are generally old and well known in the art. An early quilting machine of this type is shown in U.S. Pat. No. 260,994, issued July 11, 1882, to William Koch. Since that time, such machines have become substantially more complex and a quilting machine of the type generally available today is shown in U.S. Pat. No. 3,385,246, issued May 28, 1968, to Kurt Schlegel. For a discussion of a modern, high speed quilting machine, reference should be had to my copending U.S. patent application Ser. No. 648,002, filed concurrently herewith.

Such machines stitch together an assembly of quilting fabrics and a filler in a pattern of stitches distributed throughout the area of the assembly. In the quilting operation, the fabrics are drawn from supply rolls while the filler is drawn from a supply roll between the fabrics to form an assembly of filler sandwiched between an upper and lower fabric. The assembly is then passed through the stitching mechanism by means of drawing rollers.

The stitching mechanism is a stationary unit and the bed place has a plurality of holes therein, spaced transversely of the direction of movement of the material assembly, through which the needles may pass downwardly to shuttles or bobbins mounted beneath the bed plate, one for each hole and needle. Stitches are made by a downward movement of the needles through the material assembly and into and through the holes in the bed plate. Upon upward movement of the needles, loops are formed in the threads, below the bed plate, through which the shuttles or bobbins conduct second lengths of thread, whereupon the needles are further withdrawn and the threads pulled tight to form the stitches.

During the stitching operation, the presser foot is first lowered onto the material assembly to hold it in place on the bed plate and then elevated slightly to permit forward movement of the material assembly. The presser foot also limits upward movement of the assembly so that the needles may be withdrawn therefrom. The presser foot includes a similar plurality of transversely oriented holes, aligned with the holes in the bed plate, for passage therethrough of the needles during the stitching operation.

In a conventional quilting machine, the presser foot is supported at a plurality of spaced locations by brackets which are connected to the lower ends of vertically oriented rods which extend through a plurality of spaced, rigid bearings. Thus, the bearings support the rods, the brackets, and the presser foot for vertical reciprocation relative to the bed plate. A spring is typically positioned around each support rod, between its associated bearing and bracket, to normally urge the presser foot downwardly into contact with the bed plate or the material thereon.

The presser foot is normally driven by the same oscillatory shaft which is utilized to vertically reciprocate the needles of the quilting machine. That is, by mounting a plurality of spaced eccentrics on the needle drive oscillatory shaft and an eccentric follower on each presser foot support rod, the eccentrics may be utilized to cyclically lift the presser foot off the bed plate, compressing the springs. In another position of the oscillatory shaft, the eccentrics release the eccentric followers and the springs are permitted to force the presser foot downwardly onto the bed plate.

In a conventional quilting machine, of the type described above, the springs surrounding the presser foot support rods literally thrust the presser foot downwardly onto the bed plate when the eccentrics release the eccentric followers. This action has proven to be one of the greatest sources of noise, vibration, and wear associated with conventional quilting machines. The noise creates an unpleasant working environment for the machine operators. The vibration contributes to the problem of thread breakage, thereby limiting the productivity of the quilting machine. The vibration also causes excessive wear of the parts so that the machine must be overhauled relatively frequently. Furthermore, because of the thread breakage and other problems, the machine must be constantly monitored by a relatively highly skilled operator, thereby increasing operating costs.

SUMMARY OF THE INVENTION

According to the present invention, there is provided a floating presser foot for a quilting machine which solves these problems in a manner unknown heretofore. With the present presser foot suspension and drive system, a major portion of the noise and vibration normally associated with presser foot systems is virtually eliminated. By eliminating the vibration and wear associated therewith, a quilting machine incorporating the present presser foot system is more efficient and requires overhauling less frequently than necessary heretofore. By minimizing the thread breakage problem, the number of variables that an operator must monitor is decreased so that an operator having a lower level of skill and requiring less training may be used, thereby achieving a still further decrease in operating costs.

Briefly, the present invention is intended primarily for use in a quilting machine of the type including a bed plate, means for conducting material to be quilted over the bed plate, vertically reciprocal needles positioned above the bed plate for moving sewing threads through the material to form stitches therein, presser foot means positioned above the bed plate, means for supporting the presser foot means for vertical reciprocation relative to the bed plate between upper and lower positions for periodically compressing and releasing the material, and means for driving the presser foot means. According to the present invention, the means for supporting the presser foot means comprises means including a pair of opposed, balanced springs for suspending the presser foot means in a position intermediate the upper and lower positions and the means for driving the presser foot means comprises means for cyclically, alternately, increasing and decreasing the compression of one of the springs and simultaneously decreasing and increasing the compression of the other of the springs to reciprocate the presser foot means between the upper and lower positions.

OBJECTS

It is therefore an object of the present invention to provide a floating presser foot for a quilting machine.

It is a further object of the present invention to provide a presser foot suspension and drive system for a quilting machine.

It is a still further object of the present invention to provide a floating presser foot for a quilting machine which minimizes the normal noise associated with quilting machines.

It is another object of the present invention to provide a floating presser foot for a quilting machine which minimizes wear in the presser foot suspension and drive system.

It is still another object of the present invention to provide a floating presser foot for a quilting machine which minimizes machine vibration.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
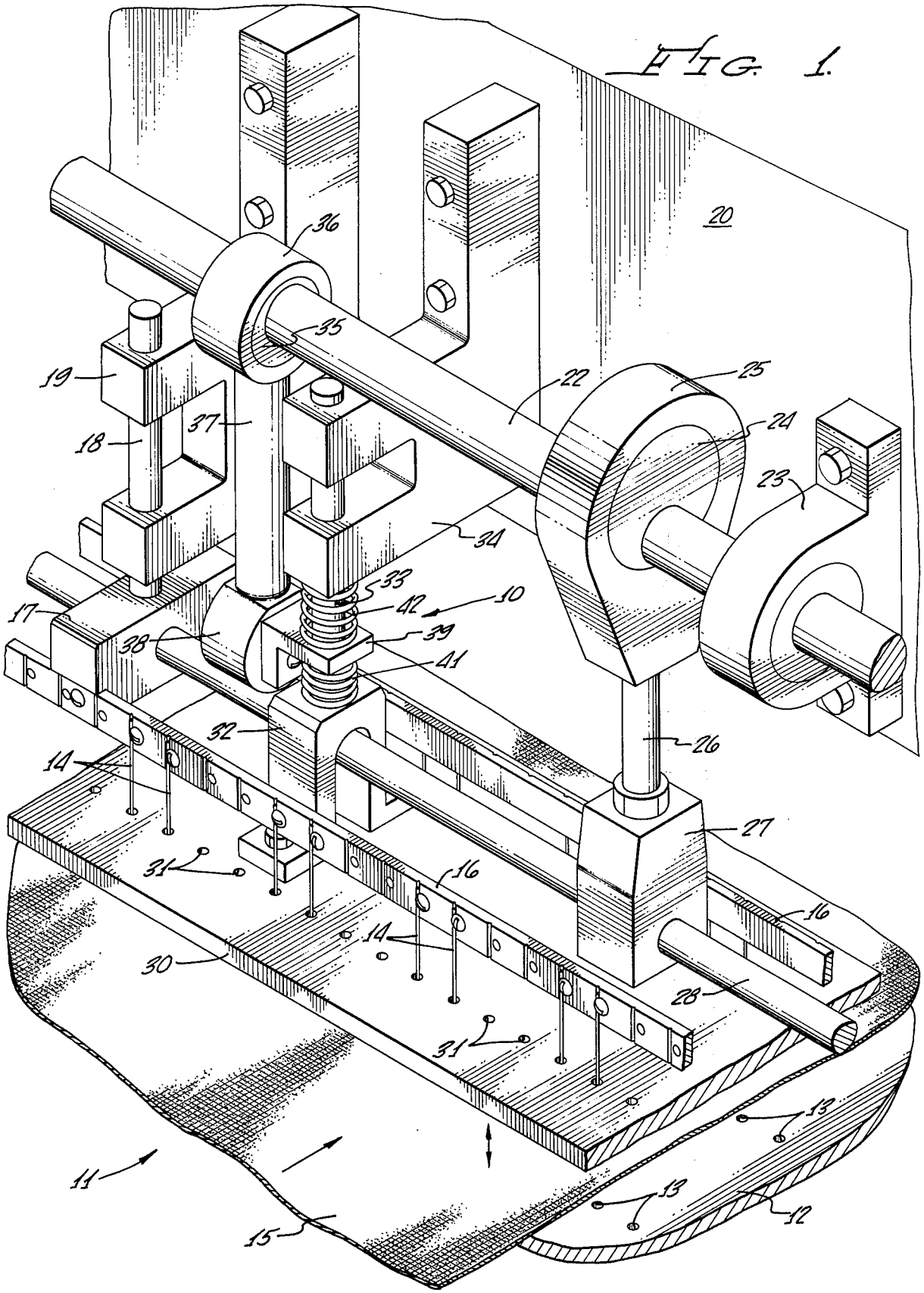
FIG. 1 is a perspective view of a portion of a quilting machine incorporating the present presser foot suspension and drive system.

Referring now to the drawings, the present presser foot suspension and drive system, generally designated 10, is intended primarily for use in a quilting machine, generally designated 11, of the type including a bed plate 12 which extends horizontally and is supported by means, not shown, above a support surface. Bed plate 12 has a plurality of rows of multiple holes 13 therein, space transversely of the direction of movement of a material assembly 15 over bed plate 12, there being one hole 13 in bed plate 12 for each sewing needle 14 of quilting machine 11.

Quilting machine 11 further includes material supporting means, not shown, including material feeding means, also not shown, for conducting material assembly 15 over bed plate 12. As is known in the art, material assembly 15 typically consists of two sheets of quilting fabric and a length of filler material therebetween.

Quilting machine 11 further includes sewing thread supply means, not shown, including a plurality of spools of thread, there being at least one spool for each of the needles 14 of machine 11. Sewing thread supply means are conventional and well known to those skilled in the art.

Quilting machine 11 includes a plurality of vertically reciprocal needles 14 positioned above bed plate 12 for moving the sewing threads through material assembly 15 and bed plate 12. Needles 14 are typically arranged in one or more rows, each row of needles 14 being connected to an elongate support bar 16. By way of example, two rows of needles 14 and two support bars 16 are shown in the present embodiment. Support bars 16 are supported at a plurality of locations along the lengths thereof by brackets 17, each bracket 17 being connected to the lower end of a rod 18. Rods 18 are mounted for vertically reciprocal movement in bearing blocks 19 which are rigidly connected to a bridge 20 which is part of the supporting frame of machine 11. Thus, needles 14, needle support bars 16, brackets 17, and rods 18 move vertically as a single unit relative to bearing blocks 19.

According to the invention of my beforementioned copending U.S. patent application, needles 14 are driven directly from a rotary drive shaft 22 connected to the front of bridge 20, shaft 22 being supported for rotation relative to bridge 20 by means of a plurality of spaced bearings 23. Shaft 22 extends across the front of quilting machine 11, directly above needle support bars 16. A plurality of spaced eccentrics 24 are positioned along shaft 22, each eccentric 24 having an eccentric follower 25 associated therewith. Each follower 25 is connected by a connecting rod 26 to a terminal block 27, all of which are connected to an elongate shaft 28 which extends transversely of quilting machine 11, between support bars 16. Shaft 28 extends through and is connected to each of brackets 17. Thus, shaft 28 interconnects brackets 17 and 27, support bars 16, and needles 14 and the entire assembly is driven in a continuous oscillatory fashion by eccentrics 24, which are driven continuously with shaft 22.

For a fuller discussion of a complete quilting machine, reference should be had to my beforementioned copending U.S. patent application filed concurrently herewith. As described more fully therein, quilting machine 11 further includes thread take-up means, not shown, positioned between the beforementioned thread supply means and needles 14 for controlling the tension in the threads during operation of quilting machine 11. Quilting machine 11 further includes a plurality of horizontally reciprocal shuttles, not shown, mounted below bed plate 12, which cooperate with vertically reciprocal needles 14 to form lock stitches in material assembly 15. Both the thread take-up means and the shuttles are generally well known to those skilled in the art. Quilting machine 11 also includes pattern controlling means, not shown, for moving material assembly 15 laterally, in a preselected relationship with the material feeding means, for obtaining sewing patterns. Such means is also well known to those skilled in the art.

Quilting machine 11 further includes presser foot means, consisting of an elongate, generally rectangular, planar presser foot 30 positioned directly above bed plate 12, parallel thereto, for holding material assembly 15 down on bed plate 12 during a portion of the stitching cycle and also for limiting the upward movement of material assembly 15 so that needles 14 may be withdrawn therefrom. As is conventional in the art, presser foot 30 has a plurality of rows of multiple holes 31 therein, two rows in the present embodiment, spaced transversely of the direction of movement of material assembly 15 over bed plate 12, there being one hole 31 in presser foot 30 for each sewing needle 14 and for each hole 13 in bed plate 12. By aligning holes 31 in presser foot 30 with holes 13 in bed plate 12, needles 14 may reciprocate therethrough so that presser foot 30 does not interfere with the sewing operation.

According to the present invention, presser foot suspension and drive system 10 includes a plurality of spaced, generally U-shaped brackets 32 which are connected to presser foot 30 at spaced points along the length thereof. Each bracket 32 is connected to the lower end of a support rod 33, all rods 33 being mounted for vertical reciprocation in bearing blocks 34 which are connected to bridge 20. Bearing blocks 34 are similar in construction and operation to bearing blocks 19 for rods 18. Thus, presser foot 30, brackets 32, and rods 33 vertically reciprocate relative to quilting machine 11 by the support provided by bearing blocks 34. Furthermore, the shape of brackets 32 permits passage of shaft 28 therethrough so that shaft 28 and brackets 32 may oscillate independently of each other.

Figure 2:
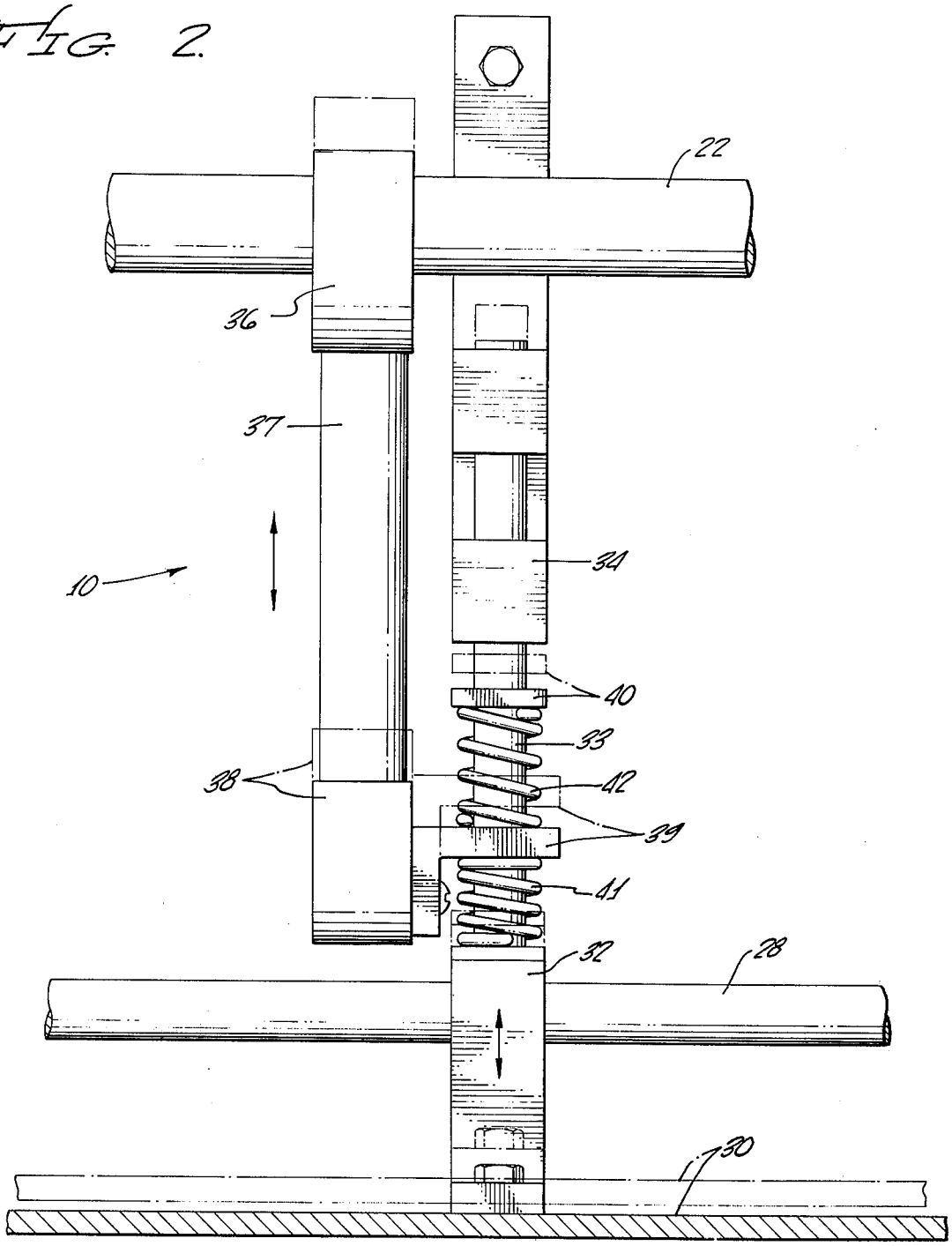
FIG. 2 is a front elevation view of the presser foot suspension and drive system of FIG. 1.

According to the present invention, presser foot 30 is driven directly from drive shaft 22 in a manner such that the timing thereof may be adjusted independently of the timing of needles 14 and the remaining oscillatory components of quilting machine 11. As shown in FIGS. 1 and 2, presser foot suspension and drive system 10 includes a plurality of spaced eccentrics 35, only one being shown, mounted on shaft 22, the angular orientation of which may be adjusted independently of the angular orientation of eccentrics 24. Each eccentric 35 has mounted thereon an eccentric follower ring 36 which is connected by a connecting rod 37 and a bracket 38 to one arm of an L-shaped bracket 39, the other arm of which has a hole therein through which one of rods 33 pass. Each rod 33 has mounted thereon a collar 40, just below bearing block 34, brackets 39 being positioned midway between collars 40 and brackets 32. A first spring 41 surrounds each rod 33 and extends between brackets 32 and 39. A second spring 42 surrounds each rod 33 and extends between brackets 39 and collar 40.

OPERATION

In operation, presser foot 30 is supported by bearing blocks 34 for vertical reciprocation relative to bed plate 12 between a lower position, shown in solid lines in FIG. 2, and an upper position, shown in phantom in FIG. 2. In the lower position, presser foot 30 holds material assembly 15 tightly on bed plate 12, compressing material assembly 15 and aiding in the efficient formation of loops in the sewing threads beneath bed plate 12 for passage of the shuttles therethrough. When moved to the upper position, presser foot 30 releases material assembly 15, permitting forward movement thereof. Presser foot 30 moves upwardly only slightly to also function to limit the upward movement of material assembly 15 so that needles 14 may be withdrawn therefrom.

Suspension and drive system 10 normally suspends presser foot 30 in an intermediate position between the upper and lower positions. That is, regardless of the position of bracket means 39, springs 41 and 42 apply equal and opposite forces to bracket 32 and collar 40, respectively, both of which are rigidly connected to rod 33. Thus, in the absence of movement of brackets 39, rods 33 are urged away from bed plate 12 and toward bed plate 12 by equal and opposite forces so that rods 33 and presser foot 30 remain stationary.

As shaft 22 rotates during the operation of quilting machine 11, eccentrics 35 are rotated therewith, causing follower rings 36, connecting rods 37, and brackets 38 and 39 to oscillate in a vertical direction. As brackets 39 move upwardly, simultaneously increasing the compression of springs 42 and decreasing the compression of springs 41, collars 40 are urged upwardly while the downward force on brackets 32 is reduced. The overall effect is to elevate rods 33, brackets 32, and presser foot 30 to equalize the forces. When brackets 39 move downwardly, reversing the situation, the compression of springs 41 increases while the compression of springs 42 decreases so that brackets 32, rods 33, and presser foot 30 move downwardly.

In other words, springs 41 and 42, being both opposed and balanced, normally bias presser foot 30 in a position intermediate the upper and lower positions so that presser foot 30 literally "floats" relative to bed plate 12. Bracket 39 cyclically and alternately increases and then decreases the compression of one of the springs while simultaneously decreasing and increasing the compression of the other of the springs so as to urge collars 40, rods 33, brackets 32 and presser foot 30 between the upper and lower positions. Furthermore, the relative positions of brackets 39, springs 41 and 42, brackets 32, and collars 40 are such that the lower position of presser foot 30 is spaced slightly from bed plate 12 so that presser foot 30 never physically contacts bed plate 12.

Such a floating suspension and drive system virtually eliminates a major portion of the noise and vibration normally associated with presser foot suspension and drive systems. By eliminating the vibration associated therewith, a quilting machine incorporating suspension and drive system 10 is more efficient and requires overhauling less frequently than necessary heretofore. Elimination of the vibration further minimizes the thread breakage problem so that the number of variables that an operator must monitor is decreased. As a result, an operator having a lower level of skill and requiring less training may be used, thereby achieving a still further decrease in operating costs.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a quilting machine of the type including a bed plate, means for conducting material to be quilted over said bed plate, vertically reciprocal needles positioned above said bed plate for moving sewing threads through said material to form stitches therein, presser foot means positioned above said bed plate, means for supporting said presser foot means for vertical reciprocation relative to said bed plate between upper and lower positions for periodically compressing and releasing said material, and means for driving said presser foot means, the improvement wherein said presser foot means driving means comprises:

means including a pair of opposed, balanced springs for biasing said presser foot means in a position intermediate said upper and lower positions; and means for cyclically, alternately, increasing and decreasing the compression of one of said springs and simultaneously decreasing and increasing the compression of the other of said springs to reciprocate said presser foot means between said upper and lower positions.

2. In a quilting machine according to claim 1, the improvement wherein said springs apply equal and opposite forces to said presser foot means supporting means when said presser foot means is in said intermediate position.

3. In a quilting machine according to claim 1, the improvement wherein said compression increasing and decreasing means comprises:

operator means positioned between said springs and said presser foot means supporting means, one of said springs urging said presser foot means away from said bed plate, the other of said springs urging said presser foot means toward said bed plate; and means for vertically reciprocating said operator means toward and away from said bed plate.

4. In a quilting machine according to claim 3, the improvement wherein said presser foot means supporting means comprises:

bracket means connected to said presser foot means;

shaft means connected to said bracket means and extending perpendicular to said presser foot means; and bearing means supporting said shaft means for vertical reciprocation relative to said bed plate, said presser foot means, said bracket means, and said shaft means being rigidly interconnected for simultaneous vertical movement.

5. In a quilting machine according to claim 4, the improvement wherein said operator means is positioned adjacent said shaft means, between said bearing means and said bracket means, wherein said biasing means includes a collar connected to said shaft means, adjacent said bearing means, wherein one of said springs is positioned between said operator means and said collar, and wherein the other of said springs is positioned between said operator means and said bracket means.

6. In a quilting machine according to claim 5, the improvement wherein said springs surround said shaft means, between said bracket means and said collar, and wherein said shaft means extends through said operator means, said operator means being movable independently of said shaft means.

7. In a quilting machine of the type including a bed plate, means for conducting material to be quilted over said bed plate, vertically reciprocal needles positioned above said bed plate for moving sewing threads through said material to form stitches therein, and presser foot means positioned above said bed plate, the improvement comprising:

means for supporting said presser foot means for vertical reciprocation relative to said bed plate between upper and lower positions, said supporting means including first and second opposed, balanced, compressible members for suspending said presser foot means in an intermediate position between said upper and lower positions; and means including moveable operator means positioned between said first and second compressible members for alternately urging said presser foot means toward said upper and lower positions.

8. In a quilting machine according to claim 7, the improvement wherein said moveable operator means is positioned above said bed plate and supported for vertical reciprocation relative to said bed plate; and wherein said first and second compressible members are positioned between said moveable operator means and said presser foot means supporting means for applying equal and opposite forces to said presser foot means supporting means to maintain said presser foot means in said intermediate position.

9. In a quilting machine according to claim 8, the improvement wherin said urging means further comprises:

means for vertically reciprocating said moveable operator means in timed sequence with said vertically reciprocal needles thereby vertically reciprocating said first and second compressible members and urging said presser foot means between said upper and lower positions.

10. In a quilting machine according to claim 9, the improvement wherein said first and second compressible members comprise:

first and second springs, respectively.

11. In a quilting machine according to claim 10, the improvement wherein said presser foot means supporting means comprises:

bracket means connected to said presser foot means;

shaft means connected to said bracket means and extending perpendicular to said presser foot means; and bearing means supporting said shaft means for vertical reciprocation relative to said bed plate, said presser foot means, said bracket means, and said shaft means being rigidly interconnected for simultaneous vertical movement.

12. In a quilting machine according to claim 11, the improvement wherein said operator means is positioned adjacent said shaft means, between said bearing means and said bracket means, wherein said suspending means includes a collar connected to said shaft means, adjacent said bearing means, wherein one of said springs is positioned between said operator means and said collar, and wherein the other of said springs is positioned between said operator means and said bracket means.

13. In a quilting machine according to claim 12, the improvement wherein said springs surround said shaft means, between said bracket means and said collar, and wherein said shaft means extends through said operator means, said operator means being movable independently of said shaft means.

* * * * *